United States Patent [19]

Wittersheim

[11] 4,040,975

[45] Aug. 9, 1977

[54] FOAM GENERATOR FOR FOAMING LIQUIDS

[75] Inventor: Adam Wittersheim, Nieder-Ramstadt-Trautheim, Germany

[73] Assignee: Goldwell GmbH Chemische Fabrik H.E. Dotter, Darmstadt-Eberstadt, Germany

[21] Appl. No.: 690,458

[22] Filed: May 27, 1976

[30] Foreign Application Priority Data

| | | |
|---|---|---|
| Feb. 3, 1976 | Germany | 2604066 |
| Apr. 1, 1976 | Germany | 2614043 |

[51] Int. Cl.[2] ..... B01J 13/00; B01F 3/04

[52] U.S. Cl. ..... 252/359 E; 159/4 R; 159/16 R; 159/DIG. 4; 239/434; 239/552; 261/121 R; 261/DIG. 26

[58] Field of Search ..... 159/4 R, 4 A, 16 R, 159/16 G, DIG. 4, 1 A, 4 B; 259/4 AC; 239/434, 552; 261/121, DIG. 26; 252/359 B, 359 D, 359 E, 363

[56] References Cited

U.S. PATENT DOCUMENTS

| | | | |
|---|---|---|---|
| 729,205 | 5/1903 | Morrissey | 239/434 |
| 1,266,501 | 5/1919 | Leitch | 252/359 D |
| 1,950,968 | 3/1934 | Burlingham | 252/359 E |
| 2,051,108 | 8/1936 | Sattler | 239/552 X |
| 2,073,187 | 3/1937 | Webb | 239/552 X |
| 3,762,649 | 10/1973 | Dalhaus | 239/552 X |

FOREIGN PATENT DOCUMENTS

| | | | |
|---|---|---|---|
| 236,903 | 1/1962 | Australia | 261/121 |
| 626,684 | 2/1936 | Germany | 261/DIG. 26 |

*Primary Examiner*—Norman Yudkoff
*Assistant Examiner*—Barry I. Hollander
*Attorney, Agent, or Firm*—Allison C. Collard

[57] ABSTRACT

A foam generator for foaming liquids having two peripheral disc portions each being connected with a housing with a gas inlet to one of the housings. The housings being connected together with the peripheral disc portions forming a hollow space such that gas fed to the hollow space through the gas inlet enters the hollow space and exits between the peripheral disc portions to form air streams to foam the liquids.

10 Claims, 5 Drawing Figures

FOAM GENERATOR FOR FOAMING LIQUIDS

This invention relates to a foam generator for foaming liquids.

In particular, the invention is concerned with the foaming of liquid cosmetic substances by means of a foaming gas which is introduced into the liquid. The foam generator essentially includes a hollow housing element which is provided with a gas introducing connecting socket having fine apertures through which the introduced gas exits into the liquid to be foamed in form of a plurality of fine air streams.

Apparatus of the aforesaid type for foaming liquids are used in devices for foaming liquid cosmetic substances such as disclosed in German Laid Open to public inspection patent application No. 25 21 694. This known apparatus for foaming liquids includes a porous member made of mineral particles which are sintered together and provided with a bore which runs to the center of the member; a capillary extends from the member and acts as a connecting jacket into which the foaming gas is blown. It has been shown that these sintered elements are not only relatively expensive to manufacture, but are also not very well suited for foaming liquid cosmetic substances, as the size of the bubbles cannot be adjusted to an optimum size. For example, problems exist concerning the stability of the foam which exists from the permanent wave liquids. Furthermore, it has been noted in the known type of foaming apparatus that solid substances do form in the liquid substances which have to be foamed, so that the element gradually closes and changes its foaming characteristic.

It is therefore an object of the invention to provide an apparatus for foaming liquids which is simple to manufacture, is economical and which permits adjustment of the size and type of the bubbles in a predetermined in order to determine the required characteristic of the foam, whereby the adjusted foaming characteristic does not change even during an extended period of use.

This object of the invention is obtained in an apparatus for foaming liquids of the aforementioned type in that in accordance with the invention, the housing element comprises two disk-like housing portions, whereby at least one of the housing portions is provided with a flat recess at the side opposite to the other housing portion thus forming a hollow space when the two portions are assembled. A hollow gas blowing connection is connected to one of the housing portions and associated with a gas feeding line. The edge portions of the separating seam or joint between the two adjacent housing portions are such that fine apertures or openings are formed for the emission of air streams. The gas which is blown into the inventive element is generally taken from the ambient air and pumped into the element by a pumping means and exits radially from the element through the separating seam between the two housing portions which are made separately. Since the edge portions which define the distribution of the blown air stream into the finest or minute air streams are located on the outside before assembly, it is very simple to provide these edge portions with radially running grooves, such as channels or furrows of a defined size which form the apertures after assembling the element. This also enables a subsequent adjustment and control of the housing portions without any difficulties.

In a preferred embodiment of the invention the edge portion of at least one of the disk like housing portions is roughened, so that a large number of fine or minute apertures exist when the two housing portions are assembled. The degree of roughing, i.e., the height, number and distribution of the roughened projections defines the size of the apertures and thereby the fineness of the passing air streams and the generated size of the bubble. If, for example, the housing portions are molded with a plastic material an optimum recognized roughness may be reproduced on the molded parts by means of an electro-erosive roughening of the mold on the edge portion. Therefore, it is preferred to make the housing portion from plastic material which is also less expensive. However, it should be noted that these housing portions may also be made from metal which also provides very good results. Alternatively, an annular running disk which is thin and porous may be mounted between the two adjacent edge portions of the housing parts. The porosity of this disk defines the fineness of the air streams and thereby the bubble size.

The arrangement may be such that the degree of roughening of the edge portions in individual sections deviates from the degree of roughening from other sections in the edge portions of the housing whereby these different sections are equally distributed over the total edge portion or area of mating portions. Hence, differently sized bubbles are generated at the differently roughened sections, so that a small sized bubble foam is generated which is interspersed with larger bubbles. Such a foam is more stable with certain substances than a foam having an even or uniform size of bubble without impairing the wettability.

Preferably, the porous disk is made of a fleece, the porosity or permeability of which is such that it can be adjusted by more or less pressing the two housing portions together during assembly. The connection of the two housing portions to the housing element may be achieved by outer clamps, or the like. However, the referred connection is to provide the gas introducing connection from the outside in form of a protruding connecting socket or adaptor, while the other housing portion is provided with a retaining pin protruding from its inside. The retaining pin extends into a longitudinally formed recess in the hollow outlet and is retained therein, whereby at least one passageway remains open, i.e, not closed by the retaining pin, running from the mouth of the connecting socket to the hollow inside of the housing element.

The retaining means for both housing portions are not visible but are located inside the foam generator. The opening or passageway which guides the gas from the connecting socket into the hollow inside of the housing element is shaped at least by one longitudianlly extending groove like recess in the circumference of the retaining pin and/or the wall of the recess in the connecting socket.

A few possibilities are feasable for mounting the retaining pin in the recess. The mounting may be achieved in that the retaining pin is held in place by a press fit in a complimentary cross sectional recess. Alternatively, the retaining pin may be held in position by a positive locking with complimentary shoulders or recesses.

It is also possible to provide an embodiment whereby the retaining pin is provided with an outer thread which is screwed into a complimentary inner thread. Such an embodiment is particularly advantageous if the gas passageways in the above-mentioned disk are made of a fleecelike fiber material. This enables the adjustment or changing of the degree of gas permeability for the disk by a more or less tightening of the retaining pin.

In order to even out or balance the gas stream which is fed with respect to quantity and pressure during its flow from the connecting socket to the foam generator and to obtain a foam having a constant characteristic, a calibrated throttle bore of reduced cross section may be provided in a further embodiment of the invention in the hollow inside of the connecting socket.

A further embodiment of the invention is shown whereby the cross-section of the upper disk-like housing or portion is larger than the cross-section of the lower disklike housing or portion so that the foam bubbles which are generated in the liquid are prevented from floating upwardly within the liquid. This is due to the protruding lower side of the annular upper disk-like housing portion which overlappingly protrudes over the lower housing portion. Therefore, due to protruding edge portion changes in the bubble size are equalized at the exit for the bubbles between the housing portions. Different bubble sizes may be generated, for example, when the fine passageways between the housing portions are reduced in their cross-sections because of deposit material. In order to assure proper functioning of the above mentioned operation, the width of the annular surface of the upper housing portion must be so proportioned on the lower face thereof that in comparison to a predetermined bubble size before exiting over the outer edge of upper housing portion.

Other objects and features of the present invention will become apparent from the following detailed description when taken in connection with the accompanying drawings which disclose several embodiments of the inventin. It is to be understood that the drawings are designed for the purposes of illustration only and are not intended as a definition of the limits and scope of the invention disclosed.

In the drawings, wherein similar reference numerals denote similar elements throughout the several views.

Figure 1:
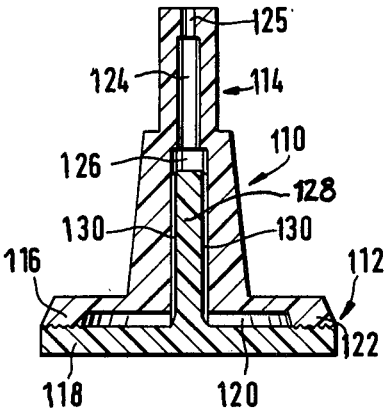
FIG. 1 is a cross-sectional view through a preferred embodiment of the foam generator.
Figure 2:
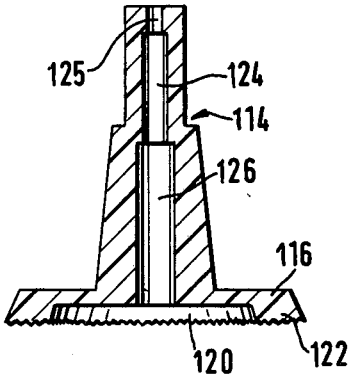
FIG. 2 is a cross-sectional view of part of the foam generator of FIG. 1 but taken through the upper housing portion thereof.
Figure 3:
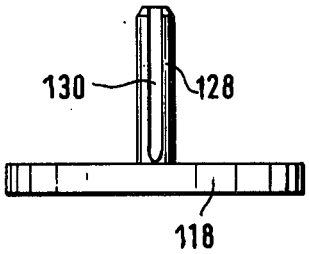
FIG. 3 is a side view of the lower housing portion of the foam generator of FIG. 1, and rotated in a 90° position with respect to FIG. 1.

Referring to the drawing, a foam generator 110 is shown in its assembled position in FIG. 1 and with its individual parts in FIGS. 2 and 3 comprises a housing element 112 with a protruding connecting socket 114 which is adapted to be connected to a feed line for compressed air or any other suitable foaming gas.

Housing element 112 includes an upper disk-like housing portion 116 which supports connecting socket 114 and a lower disk-like housing portion 118 mounted on the upper disk-like housing portion 116 which in a plan view shows a preferably annular member. The upper housing portion 116 is provided with a flat recess 120 which faces housing portion 118, whereby the flat recess is supported by an annular protruding edge porton 122. Protruding edge portion 122 is supported on the oposite edge portion on the upper side of housing portion 118 when foam generator 110 is in its assembled position. A gas inlet bore 124 extends through connecting socket 114 and at its lower portion into recess 120 whereat it expands in its cross-sectional diameter into a cylindrically-shaped recess 126. A centrally extending retaining pin 128 may be pressed into the lower housing portion 118 from above, thus providing a press fit for the retaining pin. Two oppositely arranged groove-like recesses 130 run axially parallel along the total axial length of retaining pin 128 and form passageways from gas inlet bore 124 to recess 120 when the retaining pin 128 is introduced into recess 126.

Figure 4:
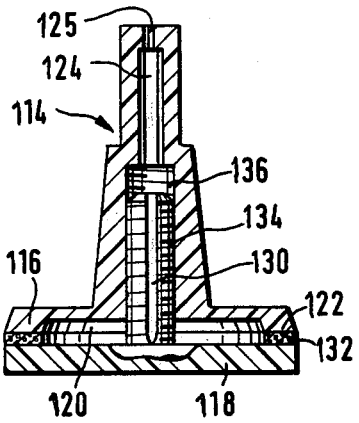
FIG. 4 is a sectional view through a second embodiment of the foam generator and shown in the same manner as FIG. 1.

The upper mouth of gas inlet bore 124 shows a throttle bore 125 of reduced cross section in FIGS. 1, 2 and 4 of foam generator 110 which independently from pressure causes a balancing in the flowing foam gas quantity which flows into the inner space of housing element 112. This throttle bore 125 could also be provided at any other suitable place within gas inlet bore 124.

Edge portion 122 of housing portion 116 which surrounds recess 120 is roughened in a defined manner as shown by the serrated face portion, so that in a separating joint or seam between this housing portion and the lower smooth upper side of housing portion 118 no gas-tight joining of both housing portion takes place. The gas which is blown through the gas inlet bore 124 into the inner housing space of foam generator 110 can radially escape through the separating joint in the foam of very fine streams through the passageways formed by the roughened protrusions. When immersing the foam generator into a liquid which is suitable for foaming these fine gas streams generated very fine foam bubbles, in such a manner that the size of the bubbles depend upon the fineness of the gas streams and the gas streams depend upon the type of roughening of the edge protions 122. For example, the roughening of the edge portions 122 may be in the form of adjacent radially running grooves. However, it has been shown that an irregular roughening is suitable by means of electro-erosion of a face of a molded portion. Since the manufacture of portions 116 and 118 by means of a molded process is very inexpensive, preferably both portions may be made by means of an injection molding process.

The embodiment shown in FIG. 4 is generally similar to the embodiment of FIGS. 1 to 3 in which like characters of reference are used to designate the same parts, but differs from the aforedescribed embodiment essentially in that the porosity of the separating joint between the upper and lower housing portions is not obtained by roughening the edge portion 122 of housing portion 116, but by placing an annular thin porous disk 132 between the two adjacent housing portions. If disk 132 is made from an elastically compressible material, for example, fleece, then the degree of porosity, i.e., the fineness of the inflowing gas streams which pass through are influenced by the tightness of the clamping between the two housing portions 116 and 118. This type of influencing is accomplished in the FIG. 4 embodiment, because the retaining pin 128 is provided with an outer thread 134, and pin 128 may be screwed into a complimentary inner thread 136 in recess 126. By more or less screwing the retaining pin 128 into the recess 126, the clamping of the fleece disk 132 is adjustable, whereby the size of the bubbles which are generated with this foam generator are also adjustable or variable.

It is to be understood that within the teaching of the subject invention further different embodiments may be employed. For example, the flat recess 120 may be located in the upper face of lower housing portion 118, whereby an edge portion is provided on the lower housing portion which would correspond to the edge portion 122 which is to be roughened or if it is in the smooth condition, joined with the roughened lower face of housing portion 116.

Instead of the press fit or thread connection between the retaining pin 128 and recess 126 as described heretofore, an anchoring of both parts may be obtained by suitable protrusions and complimentary recesses. It is essential that a safe mounting of the two housing portions with each other is obtained in such a position that the fine passageways the two housing portions in the separating joint have the desired dimensions.

Figure 5:
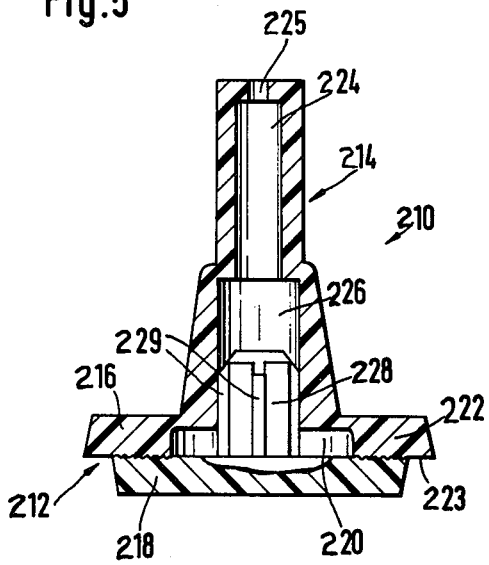
FIG. 5 is a sectional view similar to FIGS. 1–3 through a third embodiment of the foam generator of the invention.

The foam generator shown in FIG. 5 substantially corresponds to the foam generator already described in conjunction with FIGS. 1–3, so that in the following description, only the differences are explained, to avoid repetition. One of these differences is that the retaining pin 228 is provided with four longitudinally extending and protruding bars 229 which tightly engage the wall of the recess 226 and retain both housing portions 216 and 218. The remaining passageways between the bars 229 permit the exit of the foaming gas into recess 220.

However, the essential further development with respect to the previously described foam generators is that the upper disk-like housing 216 is provided with a larger diameter than the lower housing 218, so that a ring-like area 223 of the protruding edge portion 222 overlappingly protrudes over lower housing portion 218. The lower side of this ring-like area 223 may either be smooth, or may have a roughened surface which corresponds to the roughened upper portion of the lower housing for forming fine passageways in the separating seam. If the fine passageways are not formed by means of roughening the engaging surfaces but are formed by inserting a porous annular-like disk into the separating seam as shown in FIG. 4, the lower side of the protruding edge portion 222 including the ring-like area 223 is smooth.

The size of the protrusion of the ring-like area 223 defines the size of the bubbles loosening from foam generator 210 independent of the fine gas stream which exit between the housing portions 216 and 218. Bubbles which are too small are at first retained by the annular area 223 and then form, together with other small bubbles, larger bubbles which escape from the foam generator when reaching the defined size. Hence, material deposits on the fine passageways of the foam generator have no influence on the size of the generated bubbles.

While only a few embodiments of the present invention have been shown and described, it will be obvious to those skilled in the art that many changes and modifications may be made thereunto without departing from the spirit and scope of the invention.

What is claimed is:

1. A foam generator for foaming liquids including a housing element comprising:

a first housing constituting an upper housing including a peripheral disk portion;

a second housing constituting a lower housing including a peripheral disk portion;

one of said housings including a recessed area;

a protruding socket having a gas inlet bore therein;

said first housing having a cylindrically shaped recess connecting said recessed area with said gas inlet bore;

a retaining pin extending from said second housing through said recessed area into said cylindrically shaped recess and forming therewith at least one recess, said gas inlet bore and said at least one recess forming a continuous passageway connected with said recessed area: and means connecting said housings together with said peripheral disk portion in mating relationship and said recessed area of said housing facing said other housing to form a hollow space between said housings whereby gas fed to said housing element through said gas inlet bore enters said recess and said hollow space and exits between said peripheral disk portions thereby forming air streams to foam the liquids.

2. The foam generator as recited in claim 1, including an annular porous disk, said porous disk being positioned between said pheripheral disk portions.

3. The foam generator as recited in claim 3, said porous disk being a fleece fiber material.

4. The foam generator as recited in claim 1, said retaining pin being press-fitted into said cylindrically shaped recess and including a groove-like portion forming said at least one recess.

5. The foam generator as recited in claim 1, said retaining pin including an outer thread and a groove-like portion extending axially thereof along its entire length, said cylindrically shaped recess including an inner thread portion complementary to said outer thread portion to threadably receive said retaining pin in the connected condition of said first and second housings.

6. The foam generator as recited in claim 1, said retaining pin including means positively locking said pin to said first housing in said cyclindrically shaped recess.

7. The foam generator as recited in claim 1, including a calibrated throttle bore having a diameter of reduced cross-section in said protruding socket.

8. The foam generator as recited in claim 1 wherein the protruding socket has a throttle bore connected with said inlet bore and having a diameter less than the diameter of said inlet bore, said first housing having a cylindrical interior with a diameter greater than the diameter of said inlet bore, a cylindrical retaining pin connected with and extending from said peripheral disk portion of said second housing and extending into the cylindrical interior of said first housing through said recessed area, said retaining pin including a groove-like recess communicating with said inlet bore and said recessed area whereby to provide for a continuous passageway from said throttle bore through said inlet bore to said recessed area, said peripheral disk portion of said first housing including a serrated edge portion adapted to mate with a face portion of the peripheral disk portion of said second housing and form openings communicating between the exterior of said housing element and the interior thereof through said recessed area, said housings being formed of injection molded plastic material and being connected together through said retaining pin and said cylindrcal interior of said first housing, whereby to enable said housing element to be placed into liquid cosmetic substances for the foaming thereof by means of a foaming gas introduced through said housing element into the liquid cosmetic substance through openings formed between said serrated portion and said face of said second peripheral disk portion.

9. The foam generator according to claim 1 wherein the cross section of said upper housing is larger than the cross section of said lower housing portion defining a protruding ring-like area, so that the generated foam bubbles are prevented from surfacing within the liquid by the protruding ring-like area which protrudes over said lower housing.

10. The foam generator according to claim 9 wherein the width of said ring-like area of said upper housing includes an outer edge, said ring-like area is so dimensioned at a lower side thereof that in comparison to a defined bubble size, smaller bubbles are retained and are united with subsequent bubbles until they reach a predetermined size and then exit over said outer edge of said upper housing portion.

* * * * *